US005605187A

United States Patent [19]

Perrella et al.

[11] Patent Number: 5,605,187

[45] Date of Patent: Feb. 25, 1997

[54] APPARATUS AND METHOD FOR CLOSING, CONNECTING, CLAMPING AND OPENING DIE HALVES

[75] Inventors: Guido Perrella, Westmount; Nicolas Bigler, Morin Heights, both of Canada

[73] Assignee: DBM Industries Limited, Quebec, Canada

[21] Appl. No.: 330,186

[22] Filed: Oct. 27, 1994

Related U.S. Application Data

[62] Division of Ser. No. 857,463, Mar. 25, 1992, Pat. No. 5,379,827.

[30] Foreign Application Priority Data

Jun. 27, 1991 [CA] Canada ..... 2045879-8

[51] Int. Cl.[6] ..... B22D 17/26

[52] U.S. Cl. ..... 164/342; 164/137; 164/113; 164/312

[58] Field of Search ..... 164/137, 341, 164/342, 113, 312

[56] References Cited

U.S. PATENT DOCUMENTS 3,418,692 12/1986 Valyi ..... 164/341

5,035,606 7/1991 Zakich ..... 164/341

FOREIGN PATENT DOCUMENTS 2113909 4/1990 Japan .

*Primary Examiner*—Joseph J. Hail, III
*Assistant Examiner*—Randolph S. Herrick
*Attorney, Agent, or Firm*—McCormick, Paulding & Huber

[57] ABSTRACT

Apparatus and method for closing, connecting, clamping, unclamping, disconnecting and opening the die halves attached to a moving platen and fixed platen of a the die casting machine comprising clamping means, open-closing means, and connecting-disconnecting means, the clamping means comprising a clamping cylinder and a clamping piston, the open-close means comprising an open-close cylinder connected to the rear of the moving platen and an open-close piston connected to the interior center of clamping cylinder, the open-close means comprising an insertion or removal of an insertion between the clamping piston and the open-close cylinder.

4 Claims, 6 Drawing Sheets

APPARATUS AND METHOD FOR CLOSING, CONNECTING, CLAMPING AND OPENING DIE HALVES

This is a divisional of application Ser. No. 07/857,463 filed on Mar. 25, 1992, now U.S. Pat. No. 5,379,827.

This invention relates to an improved die casting machine.

BACKGROUND OF THE INVENTION

In prior art die casting machines having a frame comprised of left hand side and right hand side platens, the platens are supported by four parallel tie bars connected between opposed corners of the left hand side and right hand side platens. A moving platen having a die half on one surface thereof is mounted on said tie bars for movement towards and away from an opposing die half on the face of one of the fixed platens.

The use of four tie bars between the right and left hand side platens leaves less than 90° between any adjoining tie bars in which to change dies on the faces of the platens or to remove castings after injection is completed and the dies open. The existence of four tie bars also limits the space available to adjust or remove core plates or ejector plates mounted behind the platens.

The tie bars used in existing machines are also relatively flexible flexing as much as 20 to 40 one-thousandths of an inch during clamping of the dies for injection. Extension of the tie bars of 20 to 40 one-thousandths of an inch or more can cause torsion forces in the frame of the die casting machine which may result in misalignment of the die half faces during clamping if at least four tie bars are not used between the platens.

In prior art die casting machines it is known to use hydraulic open and close cylinders to bring the die halves into proximity and to use a toggle arrangement or a second hydraulic mechanism to clamp the die halves together immediately preceding and during injection. Said open and closing mechanism and said clamping mechanism are not disposed directly on the longitudinal centerline of the die casting machine and the application of such closing forces other than directly behind the dies can result in torsional forces in the frame of the die casting machine which may result in improper alignment of the die halves during clamping and injection of the die casting liquid.

In prior art die casting machines the injection of metal into the die halves is most frequently made through the side of one of the die halves. The liquid metal is stored in the melting pot normally above or below the side of the die halves where the liquid metal is injected through the side of one of the die halves. In travelling from the melting pot to the injection nozzle the injection fluid must turn through 90° which results in turbulence in the casting liquid which can result in an inferior finish on the casting.

In order to reduce the time of the cooling cycle it is desirable to remove as much liquid metal as possible from the large inlet runner sections of the molds as soon as the metal in the gate solidifies. The positive withdrawal of molten liquid from the large inlet runner section is only marginally assisted by gravity when injection of metal through die halves is made through the side of one of the die halves.

SUMMARY OF THE INVENTION

The die casting machine of this invention was designed to improve upon the problems with existing die casting machines described above.

The die casting machine described herein has a novel solid frame comprised of a left hand side and fixed right hand side platen connected solidly by two diagonally disposed connecting rods. A moving platen guided on the connecting rods is powered towards and away from the right hand side fixed platen. Mating faces of the moving platen and the right hand side platen each support a half die which halves are located on the faces of said platens in the plane between the diagonally disposed connecting rods.

The use of two diagonally disposed relatively inextensible connecting rods to connect the left hand and right hand side platens with the die halves located in the plane between the two connecting rods decreases possible torsion in the die casting machine because the forces and counterforces are aligned and because the connecting rods used are relatively much stronger than tie bars used in the prior art and lower extension should result in less possible torsion in the die casting machine of this invention.

The use of two substantially inextensible connecting rods as frame members leaves the operators of the machine approximately 180° between connecting rods to remove castings or to mount, repair and adjust the die half on the moving platen and right hand side platen. In conventional machines as described earlier the operators had approximately 90° between respective tie rods in which to remove castings or to mount, repair or adjust the die half.

In prior art die casting machines for large castings, it is known to use one hydraulic mechanism to bring the dies into contact and to use a toggle arrangement or a second hydraulic mechanism to clamp the die halves together. In the prior art die casting machines the mechanisms for bringing the die halves into contact and for applying clamping pressure are not both applied along the longitudinal centerline of the machine. Another aspect of the die casting machine of this invention is the use of an open and close hydraulic mechanism to open and close the die halves and the use of a clamping hydraulic mechanism to clamp the die halves together during injection. Both the open and close hydraulic mechanism and the hydraulic clamping mechanism are mounted along the longitudinal centerline of the die casting machine which longitudinal centerline is bisected by a diagonal plane passing from end to end of the machine through said connecting rods.

By utilizing relatively inextensible connecting rods and maintaining the open and closing forces and the clamping forces in a common plane passing through the longitudinal centerline of the die casting machine, possible torsion forces are reduced.

In this invention the injection of casting liquid is made from the bottom of the right hand side die half attached to the fixed right hand side platen as opposed to the central side of the die halves in conventional die casting machines. Injecting casting liquid from the bottom of the die half enables gravity to assist in removing casing fluid from the larger inlet runners after the liquid metal in the gate has solidified to reduce the time of the injection cycle. The nozzle of the injection unit enters the bottom of the right hand side die half at 45°. The casting fluid in the metal pot in which the casting fluid is maintained is only required to make a 45° turn before reaching the die half after leaving the melting pot. In conventional arrangements the casting fluid has to make a 90° turn which may cause turbulence and can result in a less polished appearance than can be obtained using the injection mechanism of this invention. In addition to less turbulence the use of a 45° connection between the metal pot and the die half enables the metal pot to be placed in close proximity to the right hand side fixed platen and die half decreasing possible gas entrainment in the die casting fluid.

The right hand side die half used with the injection system of this die casting machine includes a bottom having an oblique face or a face at 45° relative to the bottom of the die half. The oblique face of the right hand side die half includes an injection seat to receive an injection nozzle. The injection nozzle is supported by an injection unit which may be moved at an oblique angle such that the injection nozzle and seat have a common axis. The casting face of the right hand side die half contains an opening extending from the casting face to the inside of the injection nozzle seat. The opening in the casting face of the right hand side die half is adapted to receive a nose or protrusion extending from the face of the left hand side die half which nose or protrusion extends into the space in the right hand side die half when the die halves are clamped together for injection. The nose or protrusion of the left hand side die half serves to form part of one wall of the injection fluid inlet between the injection nozzle seat and the runner in one or both of the die halves. In addition the nose or protrusion of the left hand side die half which extends across the parting line into the space in the right hand side die half serves to remove the hollow sprue from the right hand side die half when the left hand side die half is withdrawn. The removal of the sprue with the left hand side die half clears the space in the right hand side die half down to the injection seat prior to the die halves closing for the next injection.

Referring to another aspect of this invention, the improved die casting machine of this invention has a solid frame consisting of a base, a fixed right hand side platen attached to one end of the base, a left hand side platen at the opposite end of the base, said fixed right hand side platen and the left hand side platen being connected by two relatively inextensible connecting rods mounted diagonally at opposed corners or sides of the fixed right hand side platen and left hand side platen. A moving platen is mounted on a sliding plate on the base and guided by the connecting rods for movement towards and away from the fixed platen.

The moving platen is closed and opened in two stages by two cylinders with respective pistons. One cylinder and piston called the opening and closing hydraulic cylinder is used to move the moving platen and the die half on its face into contact with the die half on the face of the right hand side fixed platen. The second hydraulic cylinder and piston is called the clamping mechanism and is used to clamp the die halves together during injection and release the die halves from clamping once the injection has ended and the casting has solidified.

The clamping cylinder is an integral part of the left hand side platen which platen together with the right hand side platen and two tie bars forms a solid frame. The clamping piston has a shape similar to the clamping cylinder but with a smaller diameter in order to fit within the clamping cylinder. The open and close cylinder is fastened along the longitudinal centerline of the machine to the back of the moving platen. The piston of the open and close cylinder is permanently attached to the central portion of the clamping piston. The piston of the open and close cylinder does not move during the open and close cycle of the open and close cylinder but the open and close cylinder attached to the moving platen moves longitudinally backward and forward along the longitudinal centerline of the die casting machine relative to the piston of the open and close cylinder.

As the open and close cylinder and the moving platen which it moves approach the parting line, a clearance exists between the back of the open and close cylinder and the front of the clamping piston. In order for the clamping piston to drive the open and close cylinder, locking plates which are mounted on pistons disposed perpendicularly to the centerline of the machine just in advance of the open position of the clamping piston are moved towards the centerline of the die casting machine and interposed between the forward face of the clamping piston and back end of the open and close cylinder.

The locking plates are interposed between the front face of the clamping piston and the rear face of the open and close cylinder during the clamping sequence so that the moving platen and its die half is clamped against the fixed die half mounted on the fixed right hand side platen with sufficient force to prevent any flashing during injection. Following injection the clamping piston is withdrawn from the locking plate, the locking plates are removed perpendicularly away from the centerline of the machine clear of the open and close cylinder, and the open and close cylinder is moved towards the left hand side of the die casting machine creating a clearance between the die half attached to the moving platen and the die attached to the fixed right hand side platen so that the casting may be removed.

The improved die casting machine of this invention includes a novel injection system in which the injection is made from the bottom of the mold as opposed to conventional machines in which injection occurs from the central side of the mold. Injecting material from the bottom of the mold enables gravity to assist in withdrawing zinc from the large inlet runner shortly after the gate to the cavity has solidified. The injection unit of this invention includes an injection unit terminating in an injection nozzle which fits into an oblique face in the bottom of the right hand die half at an oblique angle, such as 45°. Because the injection nozzle enters the die half at 45° rather than a conventional 90° turn there is less turbulence created in the injected fluid as it enters the die half. The minipot or other container for holding the injection fluid is maintained adjacent the injection nozzle and the injection fluid has a short distance to travel to the die halves decreasing time for injection and possible air entrainment in the injection fluid.

DESCRIPTION OF THE PREFERRED EMBODIMENTS

In one embodiment this invention relates to a die casting machine having a frame comprising two connecting rods, two side platens, a moving platen, connecting rod apertures in said moving platen, a moving platen drive and two die halves, wherein one side platen is connected to the two connecting rods, the other side platen is connected to the opposite ends of the two connecting rods, the moving platen is guided by said two connecting rods for movement towards or away from respective side platens by said moving platen drive, one die half mounted on one face of the moving platen and the other die half mounted on the inside face of the moving platen, all said platens being located in parallel planes at right angles to the centerline of the machine, the two connecting rods, the moving platen drive and the die halves being in a common plane passing through the longitudinal centerline of the die casting machine.

In another embodiment the invention relates to a die casting machine having a frame comprised of at least three connecting rods, two side platens and a moving platen wherein one side platen is connected to the connecting rods, the other side platen is connected to the opposite ends of the connecting rods, the moving platen is guided by said connecting rods for movement towards or away from respective side platens, the connecting rods are disposed at equal angles to one another relative to the longitudinal centerline of the die casting machine.

In another embodiment this invention relates to a frame for a die casting machine comprising comprising two connecting rods, two side platens and a moving platen wherein one side platen is connected to one end of the two connecting rods, the other side platen is connected to the opposite ends of the two connecting rods, the moving platen is guided by said connecting rods for movement towards or away from respective side platens, all said platens being located in parallel planes at right angles to the centerline of the machine, said connecting rods being in a plane which passes through the longitudinal centerline of the die casting machine.

In still another embodiment this invention relates to drive means for closing, clamping and opening the dies of a die-casting machine having a fixed platen with a die half attached to one face thereof, a moving platen with a die half attached to one face thereof and a parting line on which the two die halves close immediately prior to injection of casting fluid, wherein the drive means is comprised of an open-close drive means to move the moving platen close to said parting line, a clamping cylinder, a clamping piston, means to connect the clamping piston and open-close drive means, means for energizing the clamping piston for clamping said die halves together, means for disconnecting said clamping piston and open-close drive means after deenergizing of the clamping piston.

A further embodiment of the invention relates to an injection unit for a die casting machine comprising a die casting fluid container, an injection nozzle and die casting fluid controls, wherein the injection unit is disposed relative to the die casting machine so that the injection nozzle may be inserted in the bottom of the fixed die half.

Another aspect of the invention relates to an improved moving platen for use in a die casting machine comprised of a frame comprising two side platens, at least two connecting rods, and a moving platen, apertures in the moving platen, where one side platen is connected to the connecting rods, the other side platen is connected to the opposite end of the connecting rods, and the moving platen is guided by said connecting rods, the improvement wherein the moving platen incorporates a cylindrical moving platen guide integral with the moving platen and having a common axis with the aperture in the moving platen which is guided by the connecting rods.

A further aspect of the invention relates to an improved control for a die casting machine having two moving platens with die halves closing on a part line or one fixed platen with a die half and one moving platen with a die half comprised of a linear velocity displacement transducer, in which one element of the linear velocity transducer is mounted on one platen and the second element of linear velocity displacement transducer is mounted on the other platen, and said linear velocity displacement transducer will only order injection to commence when said platens and dies are in fully clamped position.

The invention also relates to a die half for a die casting machine having a die casting face, a bottom surface, an oblique angled face and a nozzle seat, wherein the bottom surface has an oblique angled face with a nozzle seat therein, the die casting face having an opening therein which extends through to the nozzle seat.

In another embodiment the invention relates to a method of closing, clamping and opening the die halves of a die casting machine having two fixed platens, a moving platen, open-close means to open and close the moving platen, a clamping mechanism having a cylinder and piston, means to connect and disconnect the clamping piston and the open close means, one die half is connected to one fixed platen and the other die half is connected to the moving platen, a structural member connected to the back of the moving platen, the method comprising the steps of closing the open-close means to move the die half on the moving platen into contact with the die half on the fixed platen, closing the connecting means to provide a connection between the clamping piston and the structural member when the clamping piston is closing, closing the clamping piston to clamp the die halves, maintaining the clamping cylinder closed while casting, opening the clamping piston when casting is completed, withdrawing the connection between the clamping piston and open-close means, opening the open-close means.

Another aspect of the invention relates to a method of injecting die casting fluid in a die casting machine, the die casting machine having a fixed platen, a die connected to the fixed platen, an injection nozzle receiving means in the bottom of the die half mounted on the fixed platen, an injection unit to inject casting fluid into said die half, the injection unit having an exterior frame member, an interior frame member, means to move said interior frame member at an oblique angle relative to the exterior frame to and away from the bottom of the die casting machine, a minipot and injection nozzle mounted on said interior frame member, including the steps of securing a die half to the fixed platen, connecting said exterior frame to said fixed platen in one of several predetermined positions, moving said interior frame, minipot and injection unit obliquely upwards towards the bottom of said die half until the injection nozzle seats in the injection nozzle receiving means of the die half.

BRIEF DESCRIPTION OF THE DRAWINGS

Referring to the base for a die casting machine shown in FIG. 1, the front of the machine base 1 includes lower horizontal member 2 and upper horizontal member 3 supported by front vertical side members 4 and 5 and front vertical interior members 6 and 7. The back 8 of the machine base 1 (not shown) is identical to the front of the machine base shown in FIG. 1 and the front and rear of the die casting machine are fastened to each other on the right hand side by horizontal member 9. As seen in FIG. 4, the left hand side of the machine is supported by vertical left hand side members 10 and 11. The vertical left hand side members in turn are joined by horizontal left hand side members 12 and 13. Referring to FIG. 1, lower intermediate cross members 14, 15 are disposed between and connect front horizontal member 2 and corresponding back horizontal member 23 at intermediate positions. The front lower horizontal member 2 and corresponding back horizontal member 23 sit on feet 16, 17, 18 and a fourth foot on the remaining corner, the feet are fastened to the floor. Front upper horizontal member 3 and the corresponding back upper horizontal member 24 have front sliding plate 20 and rear sliding plate 21 respectively mounted on top of said horizontal members. At the top left hand side of the machine base 1 a transverse horizontal plate 22 is fastened to the tops of front upper horizontal member 3 and the corresponding back upper horizontal member 24.

Referring to FIG. 2 there is shown a die casting machine 25 which is adapted to be mounted on machine base 1 or other suitable base. Die casting machine 25 includes a fixed right hand side platen 26, and an opposed left hand side platen 27. The fixed right hand side platen 26 is adapted to be fixedly connected to machine base 1 by bolts fixed in corresponding apertures in the footings 28 and 29 of fixed right hand side platen 26 and near the end of the right hand side of sliding plates 20 and 21. The left hand side platen 27 is mounted on left hand side platen support member 30 which is best seen in FIG. 4. The base of the left hand side platen support member 30 is welded to the top of the support base plate 31 which is bolted to transverse horizontal plate 22. As seen in FIG. 4 the left hand side platen support member 30 sits under clamping mechanism 32 of the left hand side platen 27. Clamping mechanism 32 is fastened to the left hand side platen support member 30. The left hand side platen 27 is fastened to the left hand side platen support member 30 so as to provide for relative movement of a number of thousandths of an inch between them to accommodate any expansion of the connecting rods which may occur during clamping of the dies.

The fixed right hand side platen 26 and the left hand side platen 27 are firmly interconnected by first connecting rod 35 and second connecting rod 36. The ends of the first connecting rod 35 and the ends of the second connecting rod 36 fit through apertures 38 in the fixed right hand side platen 26 and the left hand side platen and the ends 37 are secured to the fixed right hand side platen 26 and the left hand side platen 27 by fasteners 39. As seen in FIG. 3, locking plate frame 40 is connected to the inside face of left hand side platen 27. The operation of the locking plates retained in locking plate frame 40 which are integrated with the clamping mechanism 32 and shown schematically in FIGS. 7, 8 and 9 will be reviewed later. Mounted on the connecting rods 35, 36 between the fixed right hand side platen 26 and left hand side platen 27 is moving platen 45. Moving platen 45 includes first and second moving platen guides 46 and 47 which are integral with moving platen 45 and keep the moving platen 45 aligned so that the center of the moving platen 45 moves along the longitudinal centerline of die casting machine 25. The right hand face 48 of moving platen 45 has a die half 100 mounted thereon which is adapted to close with opposing die half 101 mounted on the left hand side of the fixed right hand side platen 26.

Referring to FIG. 5, the injection unit 50 is comprised of front and back exterior frame members 51 and 52. The bottom left hand side of front and back exterior frame members 51 and 52 are fastened near the base to a transverse frame member 55 which is fastened to the right hand side of machine base 1. The top left hand side of front and back exterior frame members 51 and 52 are fastened near their top to an upper plate 56 which in turn is fastened to the back of the fixed right hand platen 26. The front and back exterior frame members 51 and 52 are adapted to be fixed in one of two positions. The position chosen is based on the size of the dies. An interior moveable frame 60 is moveable at a 45° incline towards and away from fixed right hand platen 26 such that the injection nozzle may be inserted through an aperture in fixed right hand platen 26 and into engagement with an oblique face on the base of the right hand side die half 101 attached to the fixed right hand side platen 26.

Figure 1:
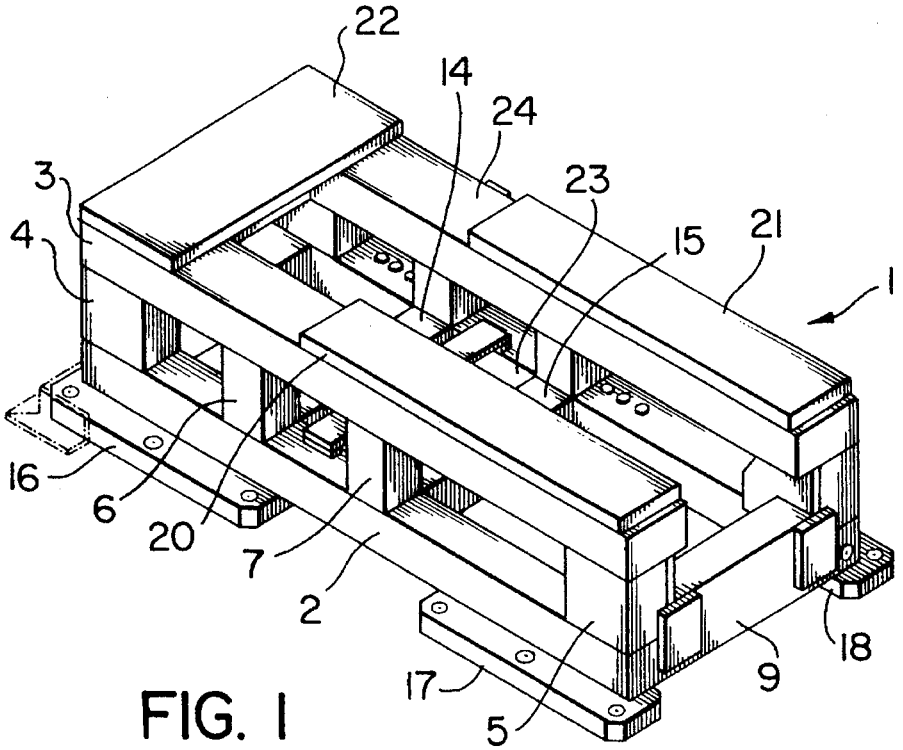
FIG. 1 is a perspective view of the machine base of the die casting machine.
Figure 2:
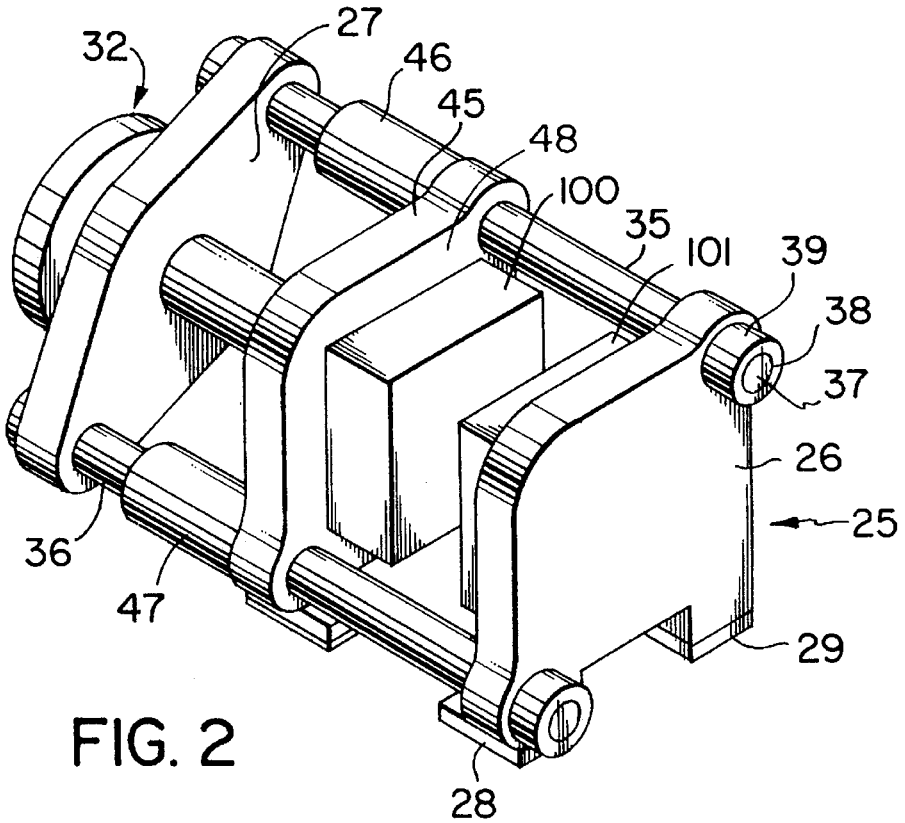
FIG. 2 is a front perspective view of a solid frame die casting machine having diagonally disposed first and second connecting rods without the injection system.
Figure 3:
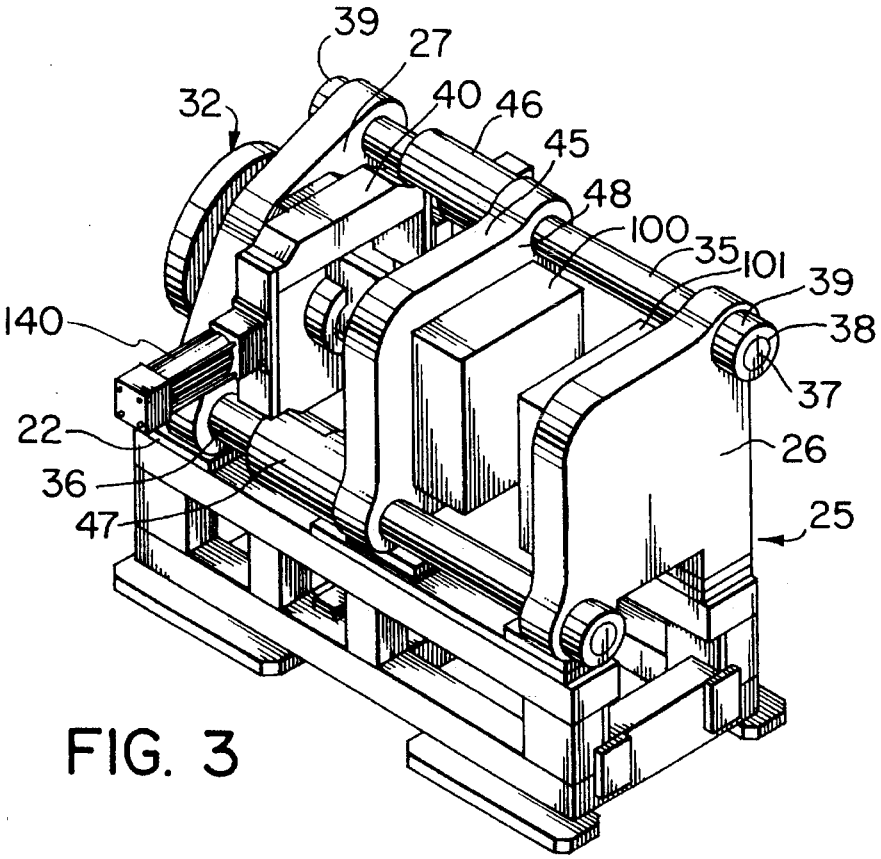
FIG. 3 is a front perspective view of the solid frame die casting machine of FIG. 2 with the addition of the locking plate mechanism.
Figure 4:
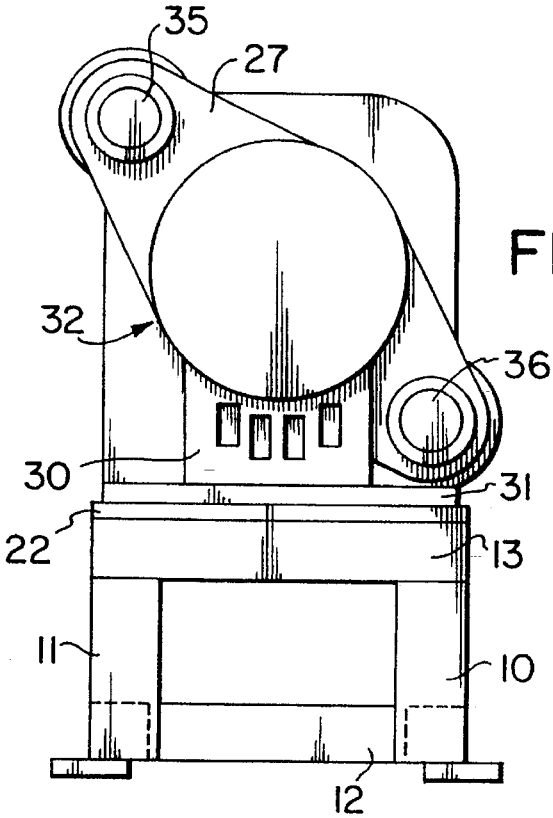
FIG. 4 is an end view of the left hand side of the solid frame die casting machine mounted on the machine base of FIG. 1.
Figure 5:
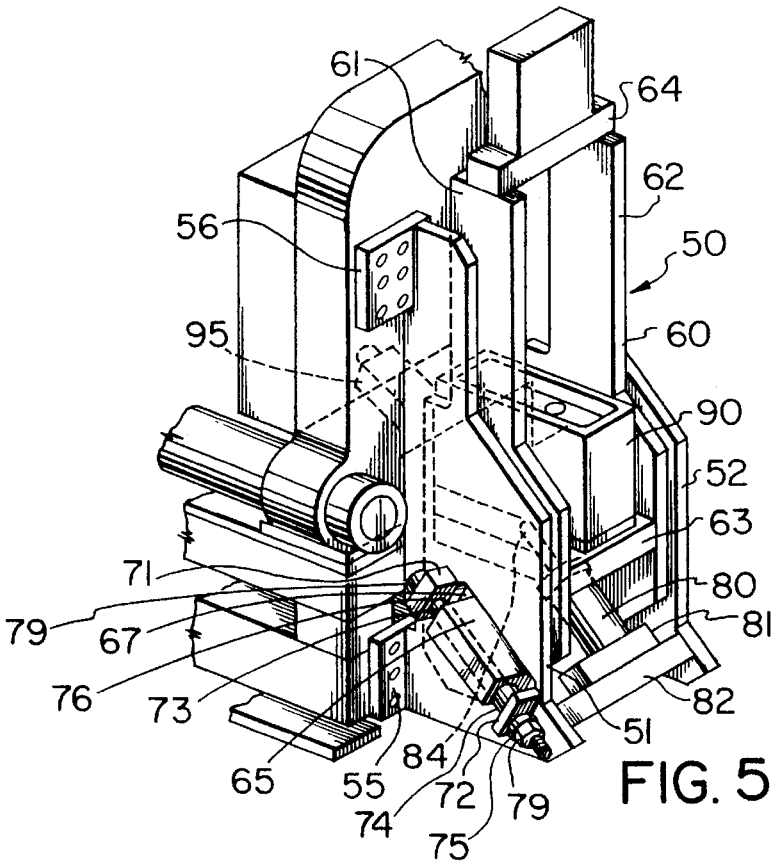
FIG. 5 is a perspective view of the injection system of the solid frame die casting machine which is integrally connected to the fixed right hand side platen of the solid frame die casting machine.

The interior moveable frame 60 of injection unit 50 is comprised of front and back interior frame members 61 and 62 which are aligned within and parallel to front and back exterior frame members 51 and 52. The front and back interior frame members 61 and 62 which are parallel to one another are maintained in parallel by horizontal base plate 63 fastened horizontally to the inside of both front and back interior frame members 61 and 62 at approximately one-third of the distance between the base and top of the front and back interior frame members 61 and 62. The top of the front and back exterior frame members 61 and 62 are connected by horizontal upper interior frame member 64. Connected at 45° to the outside of both front and back interior frame members 61 and 62 are inclined elongated rectangular guides. The elongated rectangular guide 65 is seen in FIG. 5 and a corresponding guide is similarly located on back exterior frame member 52. The elongated rectangular guide 65 is disposed through an elongated rectangular apertures 67 through the side of front exterior frame members 51. The elongated rectangular guide 65 and corresponding rear rectangular guide as they move upwardly or downwardly at 45° of the front and rear exterior frame members 51 and 52 cause the interior moveable frame 60 to move towards or away from the fixed right hand side platen 26 at a 45° incline.

Flanges 71 and 72 integral with the exterior of front exterior frame member 51 are disposed outwardly at either end of elongated rectangular aperture 67. Elongated rectangular guide 65 has shafts 73 and 74 extending from either end along the longitudinal centerline of elongated rectangular guide 65. Both flanges 71 and 72 extending outwardly from the side of front exterior frame member 51 contain apertures 75 and 76 which receive shafts 73 and 74 of elongated rectangular guide 65 respectively. The back exterior frame member 52 includes an identical arrangement of flanges and apertures as described and shown with respect to the front exterior frame member 51. The shafts 73 and 74 feature threaded ends, and lock nuts 79 are threaded on the threaded ends of shafts 73 and 74 respectively.

As mentioned earlier the horizontal base plate 63 is fastened horizontally between the inside of both front and back interior frame members 61 and 62. A piston cylinder 80 is mounted on piston cylinder support 81 which in turn is mounted on lower transverse frame member 82 between the front bottom portion of front and back exterior frame members 51 and 52. Piston 84 is integrally connected to the bottom of horizontal base plate 63. The piston cylinder 80 and piston rod 84 are disposed at 45° relative to the bottom of horizontal base plate 63 such that the horizontal base plate 63 and connected front and back interior frame members 61 and 62 and elongated rectangular guide 65 move upward or downward relative to the fixed right hand platen 26 at a 45° angle.

The minipot 90 containing liquid heated metal is mounted on the top of horizontal base plate 63. The minipot 90 is properly insulated so as not to cause any undue heating or distortion to the frames of the injection unit 50. Extending upwardly from the minipot 90 at 45° is injection nozzle support 95 which is integral with the minipot 90. In the event that hot metal is not the injecting fluid, another injection fluid container can be substituted for the minipot 90. Injection nozzle 96 extends from the top of injection nozzle support 95 at the same 45° angle. A runner 97 extends through the center of the injection nozzle 96 and injection nozzle support 95 to the bottom of injection nozzle support where the runner is connected through valving to the metal in the minipot.

The valving and arrangement between the minipot and the injection nozzle 96 and the sequence of steps in withdrawing liquid metal from the sprues after initial cooling is substantially disclosed and described in Canadian Patent 1,117,270 to Perrella and Thompson issued Feb. 2, 1982. However, the concept of introducing the injection nozzle at 45° at the bottom of the right hand side die half results in faster removal of excess metal by gravitational assistance, less turbulence in the metal because the metal does not require a 90° turn before entering the molds, and finally less turbulence and more consistent heat in the casting fluid as the minipot 90 is very close to the fixed right hand platen 26 and the die halves.

Figure 6:
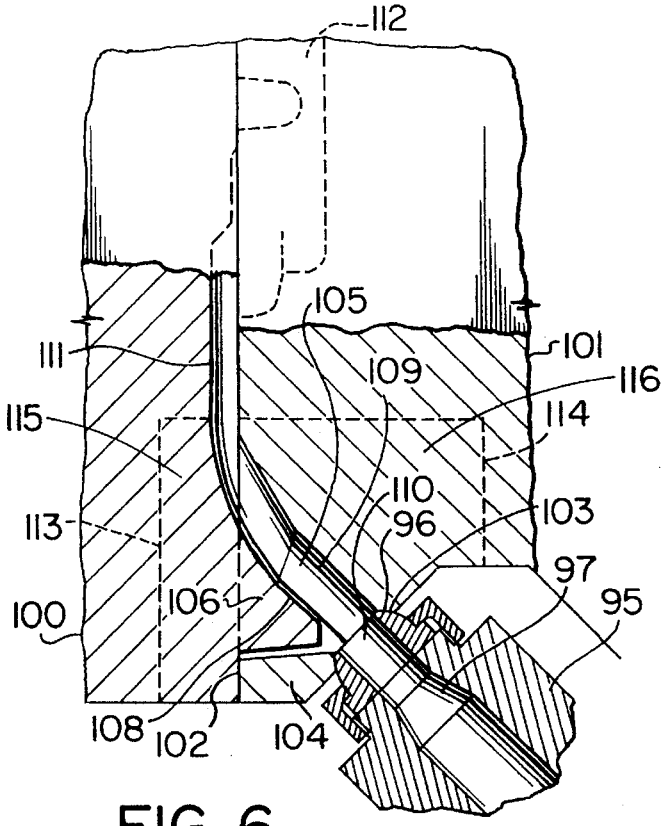
FIG. 6 is a sectional view through injection nozzle support, the injection nozzle and the bottom central portion of the left hand and right hand die halves.

FIG. 6 discloses the lower halves of the left hand side die 100 and the fixed right hand side die half 101 meeting on the part line 102. Prior to commencement of die casting, the injection nozzle 96 is inserted at 45° into contact with the bottom of the right hand side die half 101 which is fastened to the fixed right hand side platen 26. The end of the injection nozzle 96 has a spherical shape. The fixed right hand side die half 101 includes a nozzle receiving face 103 disposed at 45° relative to the bottom of the die, the nozzle receiving face 103 includes a nozzle seat 104 having a concave shape adapted to receive the spherical end of the injection nozzle 96. In setting up prior to commencement of injection the right hand side die half 101 is fastened to the fixed right hand side platen 26. The interior moveable frame 60 which supports the minipot 90, the injection nozzle support 95 and injection nozzle 96 is raised by piston cylinder 80 until the spherical end of injection nozzle 96 is firmly seated in the nozzle seat 104. Once the injection nozzle 96 is firmly seated in nozzle seat 104 lock nuts 78 and 79 for interior moveable frame 60 are tightened to lock elongated rectangular guides 65 and 66 to front and back exterior frame members 51 and 52 to lock the injection nozzle 96 in injection nozzle seat 104 of fixed right hand die half 101.

As seen in FIG. 6, the fixed right hand side die half 101 includes an opening 105. The left hand side die half 100 includes a nose shaped protrusion 106 which extends across the part line 102 when the die halves 100, 101 are closed. The bottom of protrusion 106 is completely surrounded by die casting fluid when injection occurs. The top 108 of the protrusion 106 forms the bottom of the inlet 109 from which the casting fluid proceeds from the opening 110 in injection nozzle 96 to runner 111 in left hand side die half 100 to cavity 112. While the cavity 112 is shown in the face of the right hand side die half 101, the cavity 112 may be machined out of the faces of both the left hand side die 100 and the right hand side die half 101. The lines 113 and 114 show the interior edges of inserts 115 and 116 in the left hand side die half 100 and the right hand side die 101 respectively. The inserts 115 and 116 enable the portions of the left hand die half 100 and right hand die half 101 receiving the greatest mechanical or thermal shock to be replaced without replacing the whole of left hand die half 100 or right hand die half 101. While inserts 113 and 114 are not necessary, the portions of the die halves 100 and 101 which are most likely to require adjustment during location and tightening of the injection nozzle 96 are in the area of inserts 115 and 116. In operation, the injection fluid is withdrawn from inlet 109 as soon as the metal in the gates solidifies. The withdrawal of injection fluid leaves a hollow sprue extending from the injection fluid inlet 110 through inlet 109 and runner 111. The sprue also surrounds the protrusion 106 of the left hand side die half 100 so that when the left hand side die half 100 is withdrawn from right hand side die half 101 after each injection the sprue runner and casting are withdrawn with the left hand side die half 100 leaving the opening 105 in the injection nozzle area of the right hand side die 101 clear prior to the return of left hand side die 100 from which the sprue, runner and casting have been ejected.

Figure 7:
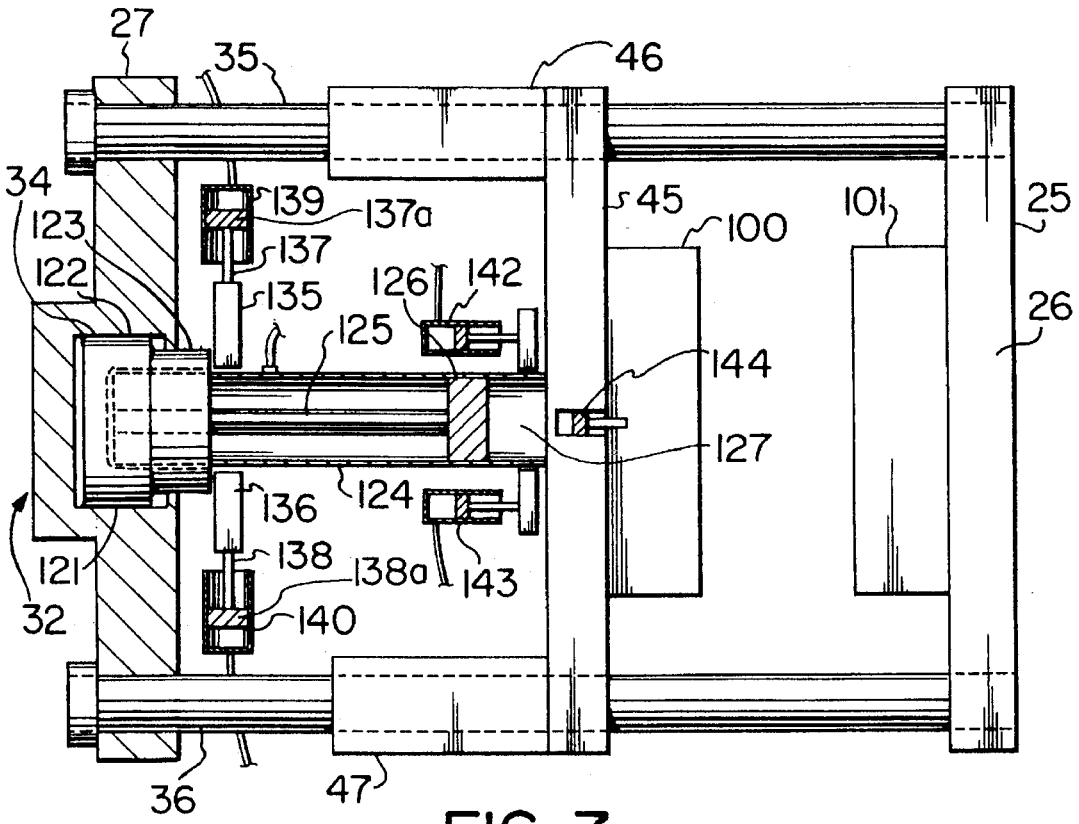
FIG. 7 is a top schematic view of the solid frame die casting machine in which the moving platen and die half are in the open position.

Referring to FIG. 7, commencing at the top of the drawing, connecting rod 35 connects left hand side platen 27 and fixed right hand side platen 26. At the bottom of the drawing connecting rod 36 connects the bottom of left hand side platen 27 and fixed right hand side platen 26. The moving platen 45 and moving platen guides 46, 47 are mounted on connecting rods 35 and 36 for movement towards and away from the fixed right hand side platen 26. Integral with the left hand side platen 27 is large clamping cylinder 32. The large clamping cylinder has a cylindrical shape with the left hand side of the clamping cylinder 32 being closed by clamping cylinder head 120. Clamping mechanism 32 has a clamping cylinder 34 and a very short clamping piston 121. The clamping piston 121 is comprised of a piston head 122 having substantially the same diameter as the interior of clamping cylinder 34 and a short piston section 123 of slightly lesser diameter. The interior central portion of the clamping piston 121 is open and is adapted to receive the open and close cylinder 124 which is fastened to the left hand side of moving platen 45.

As seen in FIG. 7, when the moving platen 45 is moved as far to the left hand side as possible the left hand end of open and close cylinder 124 fits within the interior of clamping piston 121. The open and close piston rod 125 and piston head 126 are permanently fastened to the clamping piston 121. The open and close cylinder 124 and open and close piston head 126 operate at 1000 p.s.i. and are utilized as shown in FIG. 7 to move the moving platen 45 and the left hand side die half 100 substantially into contact with the right hand side die half 101 fastened to the fixed right hand side platen 26. Immediately in front of clamping piston section 123 are locking plates 135 and 136. Locking plates 135 and 136 are mounted on platen rods 137 and 138 of pistons 137*a* and 138*a* of hydraulic cylinders 139 and 140. The hydraulic cylinders 139 and 140 are attached by support members which are not shown to left hand side platen 27. The locking plates 135 and 136 are moveable perpendicularly to the longitudinal centerline of the die casting machine and are shown in their open position in FIG. 7 of the drawings. The ejector cylinders 142 and 143 and the core cylinder 144 are mounted to the moving platen 45 and travel with the moving platen.

Figure 8:
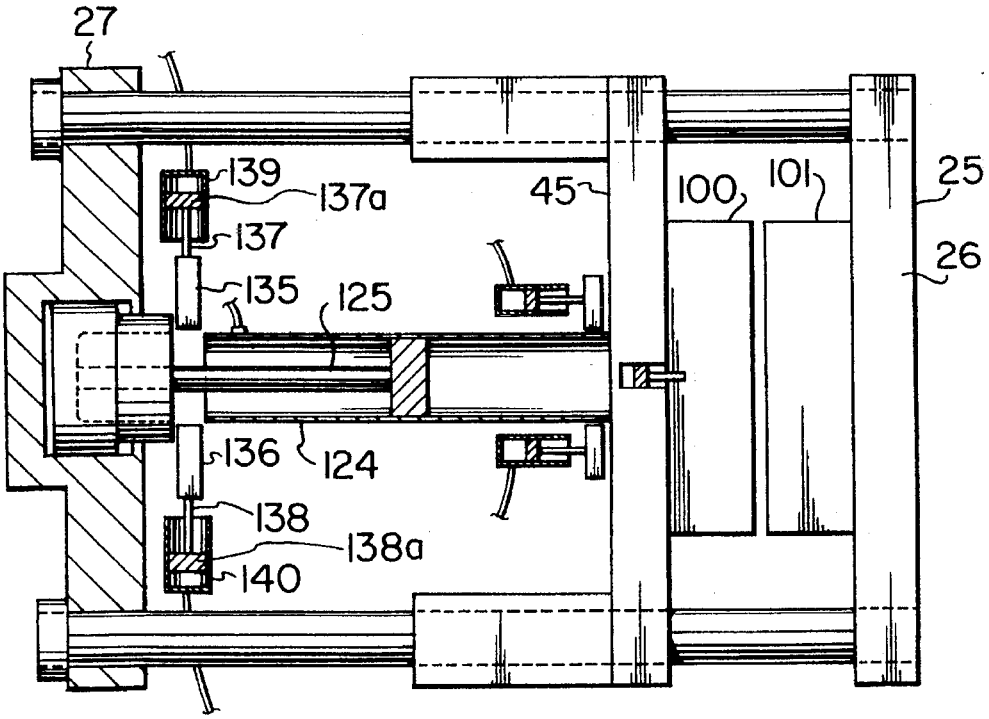
FIG. 8 is a top schematic view of the solid frame die casting machine in which the moving platen and half have been moved proximate the part line by the open-close cylinder.

As seen in FIG. 8 the open and close cylinder 124 and attached moving platen 45 and left hand side die half 100 have been moved very close to right hand side die half 101 attached to fixed right hand side platen 26. The left hand side of open and close cylinder 124 has moved just beyond the locking plates 135 and 136 leaving a space for the locking plates 135 and 136 to move towards the longitudinal centerline of the die casting machine and towards open and close piston rod 125.

Figure 9:
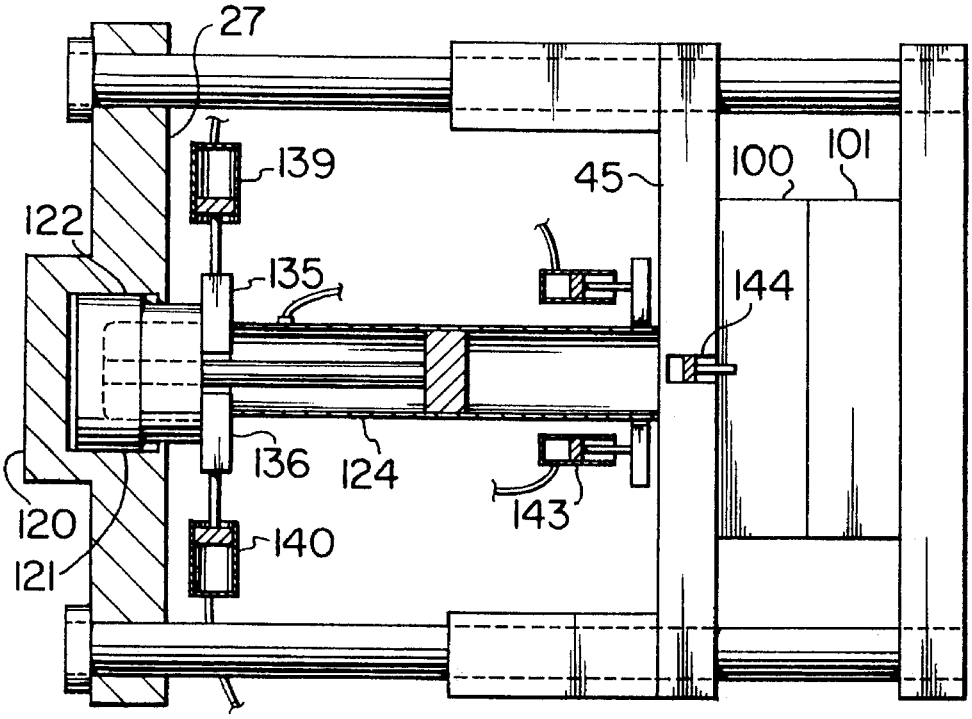
FIG. 9 is a top schematic view of the solid frame die casting machine in which the moving platen and die half are in clamped position for injection.

Referring to FIG. 9, the locking plates 135 and 136 have been moved towards the longitudinal centerline of the machine between the open and close cylinder 124 by locking plate hydraulic cylinders 139 and 140. After the locking plates 135 and 136 are introduced between clamping piston 121 and open and close cylinder 124, hydraulic fluid is applied in the space between clamping cylinder head 120 and clamping piston head 122 causing the clamping piston 122 to clamp the left hand side die half 100 to right hand side die 101 with required clamping tonnage so that metal injection can proceed. The clamping force is applied through clamping piston 121, locking plates 135, 136, open and close cylinder 124, moving platen 45 and left hand side die half 100. Once the dies are closed core cylinder 144 is activated and core rods are inserted into the dies. Following injection the clamping piston 121 is returned to its open position shown in FIG. 8 and the locking plates 135 and 136 are moved to their open position shown in FIG. 8 by locking plate hydraulic cylinders 139 and 140. Locking plate hydraulic cylinders 139 and 140 and locking plates 135 and 136 suspended therefrom are free to move laterally a very short distance during the application of clamping pressure by the clamping cylinder 121. Upon release of the clamping pressure the locking plate hydraulic cylinders 139 and 140 are returned laterally towards the left hand side of the machine by springs which are not shown. After withdrawal of clamping pressure and withdrawal of the locking plates 135 and 136 the moving platen and left hand side die half 100 will be substantially in the position shown in FIG. 8. Immediately after the release of clamping pressure from clamping cylinder 121 hydraulic pressure is applied to the left hand side of open and close cylinder 124 to cause open and close cylinder 124 to move towards left hand side platen 27 and into the position shown in FIG. 7. While the open and close cylinder 124 and moving platen 45 and left hand side die half 100 are moving left, the ejector cylinder 143 is activated to cause ejector rods which are not shown to eject the casting from the right hand side die half 101.

Figure 10:
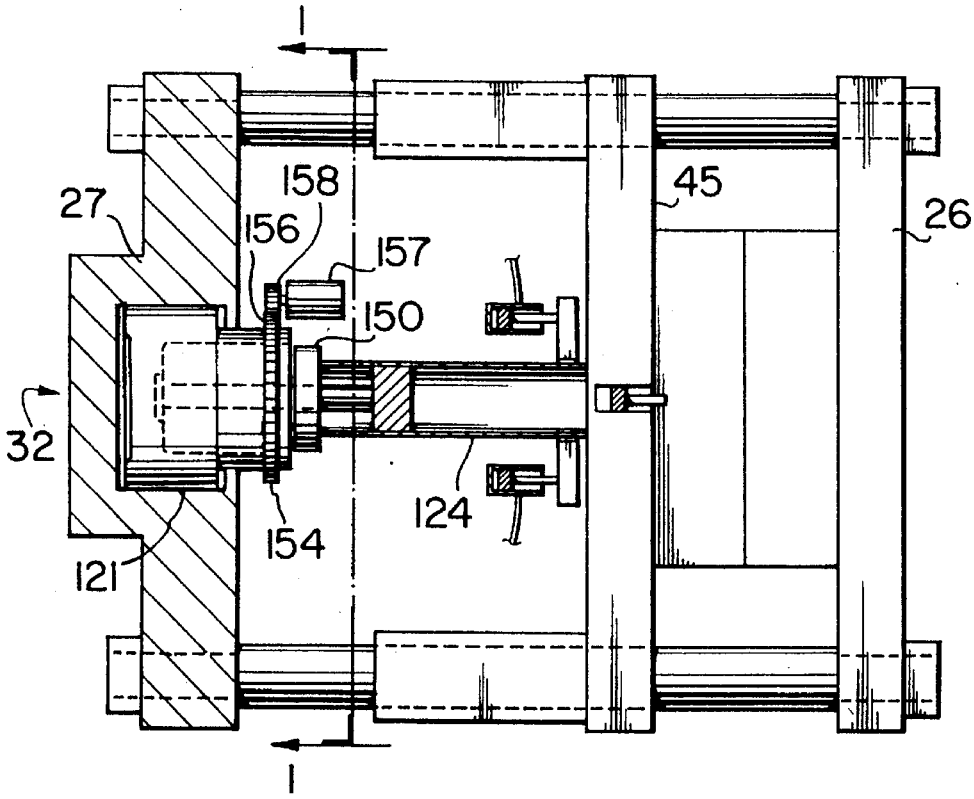
FIG. 10 is a top schematic view of the solid frame die casting machine in which a bayonet type arrangement is used to engage or disengage the clamping piston and the open-close cylinder.

Referring to FIG. 10 an alternative arrangement is shown for connecting and disconnecting the clamping piston 121 and the open close cylinder 124 in order to apply, maintain and release clamping pressure on the moving platen 45 and die halves 100, 101. A bayonet 150 having exterior grooves 151 and teeth 152 is connected to the end of the open-close cylinder 124 opposite the end connected to the moving platen 45. A bayonet ring 154 having grooves 155 which are slightly larger than the teeth 152 of the bayonet 150 is connected to the front of the clamping piston 121. When the teeth 152 of the bayonet 150 are aligned with the grooves 155 of the bayonet ring 154 the open-close cylinder 124 may be opened and the bayonet 150 and open-close cylinder 124 will move into the central open portion of the clamping piston 121. When the open-close cylinder is in this position the die halves 100, 101 will be open. The bayonet ring 154 includes gear teeth 156 on a portion of its circumference. A gear motor 157 and drive gear 158 are mounted on the left hand side platen 27. The gear motor 157 and drive gear 158 which is connected to the gear teeth 156 on the circumference of the bayonet ring 154 are designed to rotate the bayonet ring 154 when desired.

In order to clamp the die halves 100, 101 for injection the following sequence occurs. The open-close cylinder 124 is energized, driving the moving platen 45 and die half 100 proximate the parting line on which the die halves 100, 101 will ultimately clamp. The end of the open-close cylinder including bayonet 150 is clear of the bayonet ring 154 connected to the clamping piston 121. The gear motor 157 turns the drive gear 158 which in turn rotates the gear teeth 156 on bayonet ring 154 rotating bayonet ring 154 so that the teeth 159 of bayonet ring 154 are aligned with the teeth 152 of bayonet 150. The teeth 159 of the bayonet ring 154 and the teeth 152 of the bayonet 150 are engaged when the clamping cylinder 32 is energized, the clamping piston 121 and bayonet ring 154 move the bayonet 150 and open-close cylinder 124, moving platen 45 and die half 100 and clamping the left hand side die 100 with the right hand side die half 101 of the right hand side fixed platen 26 ready for injection of the casting fluid. Following injection, the clamping cylinder 32 is deenergized and the clamping piston 121 is energized to return the clamping piston 121 to the back of the clamping cylinder 32. The gear motor 157 is energized to rotate the drive gear 158 which is connected to the gear teeth 156 on the exterior of bayonet ring 154. The bayonet ring 154 is rotated until the teeth 159 of the bayonet ring 154 are opposite the grooves 151 of the bayonet 150. The open-close cylinder 124 is then energized to move part of the open-close cylinder 124 into the open interior portion of the clamping piston 121 opening the die halves 100, 101 so that the casting may be ejected.

Figure 11:
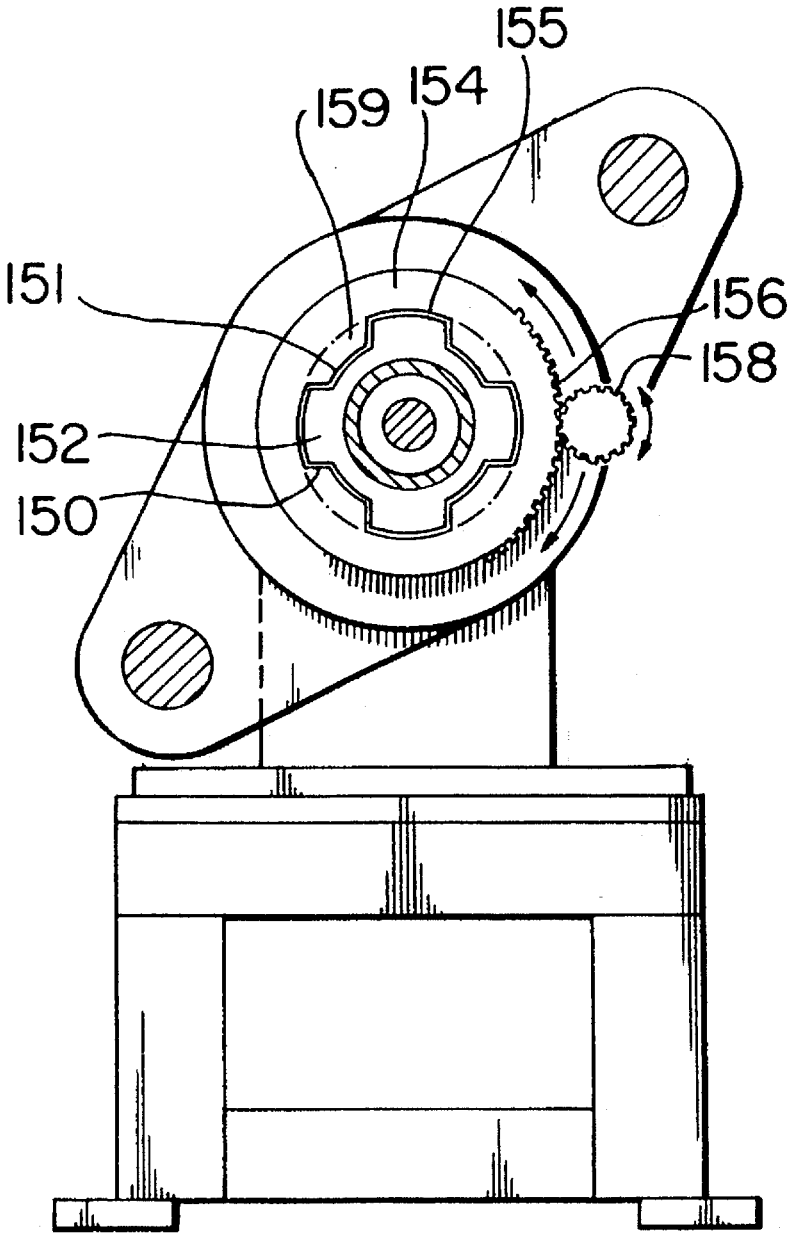
FIG. 11 is a sectional view along the section 1—1 of FIG. 10 showing detail of the bayonet engage-disengage arrangement.

FIG. 11 is a cross-sectional view along the line 1—1 of FIG. 10 showing the teeth 152 of the bayonet 150 aligned with the grooves 155 in the bayonet ring 154. With the teeth 152 of the bayonet 150 aligned with the grooves 155 of the bayonet ring 154 the left hand end of open-close cylinder 124 is moved into the open central portion of the clamping cylinder 121. In the clamping sequence, the open-close cylinder 124 is moved out of the open central portion of the clamping piston 121, the bayonet ring 154 is rotated by the gear motor 157 through 45° so that the teeth 159 of the bayonet ring 154 and the teeth 152 of the bayonet 150 are aligned. When the clamping cylinder 32 is energized the clamping piston 121 and bayonet ring 154 drive the bayonet 150 and open-close cylinder 124 towards the right hand side fixed platen 26 until the die halves 100, 101 are clamped together ready for injection.

One element of a linear velocity displacement transducer is mounted on the main moving platen and a second element of the linear velocity displacement transducer is mounted on the left hand side platen 27. When the two elements are aligned full clamping has been achieved, the linear velocity displacement transducer allows injection to commence. If the die halves are not completely closed or for some other reason the two elements of the linear velocity displacement transducer do not achieve alignment injection will not proceed and the machine cycle will be interrupted until the die casting machine has been checked.

In the above description the applicant has disclosed the use of locking plates 135 and 136 and a bayonet arrangement 150, 154 to fill the space between the clamping cylinder and the open and close cylinder during the application for clamping pressure to the moving platen. It will be recognized by those skilled in the art that other mechanical or hydraulic means may be substituted for the locking plates 135 and 136 or the bayonet arrangement 150, 154.

While the invention has been described with respect to a horizontal die casting machine it will be recognized by those skilled in the art that vertical die casting machines may be manufactured using first and second connecting rods disposed at 180° relative to one another to provide easy access to the dies, core mechanisms, ejector mechanisms and castings. Conventional types of hydraulic or mechanical mechanisms may be used to close and retract the moving platen with the die casting machines of the invention. The slight longitudinal movement allowed the left hand platen lessens any torsional forces caused during expansion of the connecting rods during clamping of the dies. The use of first and second moving platen guides assists in maintaining the molds square during clamping and injection of the casting material.

While the frame and die casting machine have been disclosed with the fixed right hand side platen, moving platen and opposed left hand side platen arranged vertically, it will be appreciated by those skilled in the art that the frame and die casting machine may be utilized with the fixed right hand side platen, moving platen and opposed left hand side platen arranged horizontally in small die casting machines.

While the invention is described with respect to a frame having two relatively inextensible connecting rods it will be realized that some of the benefits of this frame and die casting machine may be obtained with a frame and die casting machine having three connecting rods.

We claim:

1. In a die casting machine having two fixed platens including left and right hand side fixed platens, connecting rods, a moving platen, two die halves including left and right hand side die halves, a parting line, open-closing apparatus, clamping apparatus and connecting apparatus in which the two fixed platens are connected by the connecting rods, the moving platen is guided by the connecting rods, the right hand side die half attached to the right hand side fixed platen, the left hand side die half attached to the moving platen, the two die halves forming the parting line therebetween when clamped to one another, the clamping apparatus comprising a clamping cylinder and a clamping piston, the clamping cylinder connected to the left hand side fixed platen, the clamping piston being disposed in the clamping cylinder extending outwardly therefrom, the open-closing apparatus comprising an open and close cylinder, piston rod and piston head, the open and close cylinder fastened to the moving platen, an end of the open and close piston rod opposite the open and close piston head connected to the clamping piston, an end of the open and close cylinder and the clamping piston defining a space therebetween when the two die halves are proximate the parting line, means for engaging and disengaging the clamping piston and the open and close cylinder between the space therebetween in order to transmit movement of the clamping piston to the open and close cylinder and the moving platen for closing the left and right hand side die halves together at the parting line, the clamping piston defining an opening in the interior central portion thereof to receive the open and close cylinder therein when the means for engaging and disengaging is disengaged from the space at the clamping piston and the open and close cylinder and the moving platen is moved towards the left hand side platen.

2. In a die casting machine as defined in claim 1 the means for engaging and disengaging comprises a locking plate frame, a locking plate cylinder, a locking plate piston, a locking plate piston rod and a locking plate, the locking plate cylinder mounted on the locking plate frame, the locking plate piston located in the locking plate cylinder, the locking plate piston rod fastened to the locking plate piston, the locking plate connected to the end of the locking plate piston rod, the locking plate to be inserted within the space between the open and close cylinder and the clamping piston in order to transmit movement of the clamping piston to the open and close cylinder and the moving platen for closing the left and right hand side die halves together at the parting line.

3. In a die casting machine as defined in claim 1, in which the means for engaging and disengaging the clamping piston and the open and close cylinder is comprised of a rotatable bayonet clutch arrangement in which one element of the bayonet is attached to the clamping piston and the second element of the bayonet is attached to the open and close cylinder.

4. A method of operating a die casting machine having two fixed platens including a left and right hand side fixed platens, connecting rods, a moving platen, two die halves including left and right hand side die halves, a parting line, open-closing means, clamping means and connecting means in which the two fixed platens are connected by the connecting rods, the moving platen is guided by the connecting rods, the right hand side die half attached to the right hand side fixed platen, the left hand side die half attached to the moving platen, the two die halves forming the parting line therebetween when clamped to one another, the clamping means comprising a clamping cylinder and a clamping piston, the clamping cylinder connected to the left hand side fixed platen, the clamping piston disposed in the clamping cylinder extending outwardly therefrom, the open-closing means comprising an open and close cylinder, piston rod and piston head, the open and close cylinder fastened to the moving platen, an end of the open and close piston rod opposite the open and close piston head connected to the clamping piston, an end of the open and close cylinder and the clamping piston defining a space therebetween when the two die halves are proximate the parting line, connecting means to connect and disconnect the clamping piston and the open and close cylinder in order to transmit movement of the clamping piston to the open and close cylinder and the moving platen for closing the left and right hand side die halves together at the parting line, the method comprising the steps of moving the open-closing means to move the left hand side die half on the moving platen into contact with the right hand side die half on the right hand side fixed platen, moving the connecting means to provide a connection between the clamping means and the open and close means, clamping the two die halves, maintaining the two die halves clamped while casting and cooling, unclamping the two die halves, disconnecting the clamping means and the open and close means, and opening the two die halves to remove the casting.

* * * * *